US009623313B1

(12) United States Patent
Boehner et al.

(10) Patent No.: US 9,623,313 B1
(45) Date of Patent: Apr. 18, 2017

(54) SYSTEM AND METHOD TO PITCH VOLLEYBALLS

(71) Applicant: Sports Attack, LLC, Verdi, NV (US)

(72) Inventors: Douglas L Boehner, Verdi, NV (US); Bradley S Madden, Truckee, CA (US)

(73) Assignee: Sports Attack, LLC, Verdi, NV (US)

( * ) Notice: Subject to any disclaimer, the term of this patent is extended or adjusted under 35 U.S.C. 154(b) by 0 days.

(21) Appl. No.: 14/966,533

(22) Filed: Dec. 11, 2015

(51) Int. Cl.
*A63B 69/40* (2006.01)
*A63B 69/00* (2006.01)

(52) U.S. Cl.
CPC ..... *A63B 69/406* (2013.01); *A63B 69/0095* (2013.01); *A63B 2069/402* (2013.01)

(58) Field of Classification Search
CPC ..... A63B 69/406; A63B 2069/402; A63B 69/0095
USPC ..... 124/78; 473/422, 459
See application file for complete search history.

(56) References Cited

U.S. PATENT DOCUMENTS 4,026,261 A * 5/1977 Paulson ..... A63B 69/406 124/78
4,323,048 A * 4/1982 Saito ..... A63B 69/406 124/78
4,442,823 A * 4/1984 Floyd ..... A63B 69/406 124/41.1
4,561,414 A * 12/1985 Nozato ..... A63B 69/406 124/78
4,841,945 A * 6/1989 Braden ..... A63B 69/406 124/1
5,125,653 A * 6/1992 Kovacs ..... A63B 69/406 124/78
5,464,208 A * 11/1995 Pierce ..... A63B 69/406 124/78
5,649,523 A * 7/1997 Scott ..... A63B 69/406 124/78
5,865,161 A * 2/1999 Bruce ..... A63B 69/406 124/78
5,964,209 A * 10/1999 Boehner ..... A63B 69/406 124/78
6,024,078 A * 2/2000 Hollis ..... F41B 4/00 124/78
6,026,798 A * 2/2000 Sanders ..... A63B 24/0003 124/78
6,186,134 B1 * 2/2001 Battersby ..... A63B 69/406 124/78

(Continued)

*Primary Examiner* — Alexander Niconovich
(74) *Attorney, Agent, or Firm* — Carson C. K. Fincham; Fincham Downs, LLC

(57) ABSTRACT

A system and method for pitching balls, particularly round balls such as volleyballs. The system and method are flexibly designed to simulate different types of pitches including but not limited to setting, blocking, bumping, shooting, dinking, passing, tipping, digging, serving, killing and spiking. A stable base frame is configured with an integrated operator stand. A rack bar is affixed to a front portion of the frame at an inclined angle. Three wheels are mounted on an adjustable throwing head, each wheel being powered by a motor that is adjusted independently so that the relative speed of the wheels imparts different spin to a ball that is launched from the throwing head. The throwing head can be adjusted up and down on the rack bar to be as high as a jump serve release point or as low as a at floor level to simulate a dig. The apparatus is portable and fits through standard gymnasium doors.

21 Claims, 6 Drawing Sheets

(56) References Cited

U.S. PATENT DOCUMENTS

| | | | | |
|---|---|---|---|---|
| 6,237,583 | B1 * | 5/2001 | Ripley | A63B 47/002 124/78 |
| 6,488,020 | B1 * | 12/2002 | Rosas-Magallan | A63B 69/406 124/78 |
| 6,539,931 | B2 * | 4/2003 | Trajkovic | A63B 24/00 124/32 |
| 7,100,594 | B2 * | 9/2006 | Boehner | A63B 69/406 124/78 |
| 7,610,909 | B2 * | 11/2009 | Greene, Jr. | A63B 69/40 124/78 |
| 7,766,770 | B2 * | 8/2010 | Cucjen | A63B 69/406 124/51.1 |
| 7,882,831 | B2 * | 2/2011 | Alger | A63B 69/406 124/6 |
| 8,001,954 | B2 * | 8/2011 | Boehner | A63B 69/406 124/78 |
| 9,050,520 | B2 * | 6/2015 | Lu | A63B 69/406 |
| 9,180,355 | B1 * | 11/2015 | Boehner | F41B 4/00 |
| 2002/0104525 | A1 * | 8/2002 | Boehner | A63B 69/406 124/78 |
| 2005/0166905 | A1 * | 8/2005 | Boehner | A63B 69/406 124/78 |
| 2012/0097145 | A1 * | 4/2012 | Lu | A63B 69/406 124/78 |

* cited by examiner

SYSTEM AND METHOD TO PITCH VOLLEYBALLS

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

This invention relates to devices and methods for practicing sports that use balls. In particular, the invention relates to the simulation of pitching volleyballs, or other types of balls of a similar shape such as dodge balls or soccer balls.

Practicing set-up plays, entry passes, passing, tipping, digging, spiking and other pitches of a volleyball on court is difficult because it is hard to pitch balls on a repetitive basis with particular pitch types, spin types and delivery trajectories. Even the most skilled of players find it challenging to get a reasonable number of repetitions with the qualities required for training. Providing practice repetitions of one or more hit types for an entire team would be impossible without a pitching device. As volleyball and other ball sport clinics have proliferated, the demand for repetitive quality pitches has increased even further where skill training must be provided for hundreds of younger inexperienced players at one session. Quality repetitions must also be available for even the most skilled of players, including professionals. Further, since volleyball drills involve different positions on a court, they must be positioned in different areas of the court requiring a portable device that can provide repetitive quality pitches and that can be moved quickly and easily. Portability during practice sessions is critical. Portability and movability are also important for ease of moving such a device to storage rooms or facility locations, or to vehicles to be transported.

Currently, there are a number of devices on the market for simulating the pitching of a volleyball for players. However, the machines are limited in terms of capabilities for offering practice of the different types of hits that occur during a game, including but not limited to passes, tips, digs and spikes. For purposes of this disclosure, the term "volleyball" will refer to a ball that is round shaped including a dodge ball or other round ball that is of a similar size, and the terms "hitting," "setting," "blocking," "bumping," "shooting," "dinking," "passing," "tipping," "digging," "serving," "killing" and "spiking" are used interchangeably (collectively, referred to as "hits" or the action of "hitting") to generally describe the motion of propelling, pitching or throwing a volleyball. Typically, prior art volleyball pitching devices have two spinning opposing wheels that engage the ball as it passes through the wheels and impart speed and spiral spin to the ball. These opposing wheels can be adjustably rotated in unison around a central axis to cause the ball to spin in a particular direction simulating a hit curving to the right, to the left or in a straight-ahead motion. This allows for different degrees of spin imparted to the ball for simulating different types of hits.

A problem with prior art volleyball pitching devices is that they tend to have severe drawbacks. In particular, they do not offer a stable platform at different heights for different types of hits, and age or skill related differences. A two wheel throwing head is heavy. Stabilizing it at a height of approximately 10 feet off the floor to simulate a jump serve, for example, especially on recoil after a ball is launched is a significant challenge. Providing a stable platform that can simulate the flight of a jump serve with a variable spin setting in a reliably consistent manner over a significant number of pitches without failure has proven to be a challenge. Further, the prior art devices do not provide a structure that allow simulated hits from other heights in a configuration that is quick and easy to change with varying spin settings. Another drawback of prior art devices is that they are not easily portable, especially in view of the height and the stability required to provide a tall device that is capable of both jump serve hit simulations and low ball hit simulations.

SUMMARY

The present invention provides an apparatus and method for pitching vollleyballs or other round balls that may be presented to a player or groups of players in need of rapid repetition in individual and team drills that are difficult to manually replicate repeatedly. The apparatus for pitching balls includes a portable base frame that comprises sides and an operator stand. A throwing head including a head frame is adjustably mounted to the base frame and includes a ball loader that allows an operator to load a ball for throwing. The throwing head is adjustable in three dimensions: (a) rotationally, along an "x-axis;" (b) pivotally, along a "y-axis;" and (z) vertically along a "z-axis." A set of three ball throwing wheels are affixed in a configuration on a subframe that is mounted to the head frame for launching the ball from the ball loader. Each wheel is driven by a variable speed motor that is controlled by a variable switch mounted to the main frame enabling a wide range of spin characteristics. A throwing head position adjustment rack provides the ability for the throwing head to be positioned from a low position near the floor simulating a set shot to a high position at a height that approximates a jump serve release point.

BRIEF DESCRIPTION OF THE DRAWINGS

For a better understanding of the present invention, and to show more clearly how it is configured and functions, reference will now be made, by way of example, to the accompanying drawings. The drawings show embodiments of the present invention in which.

DETAILED DESCRIPTION

Figure 1:
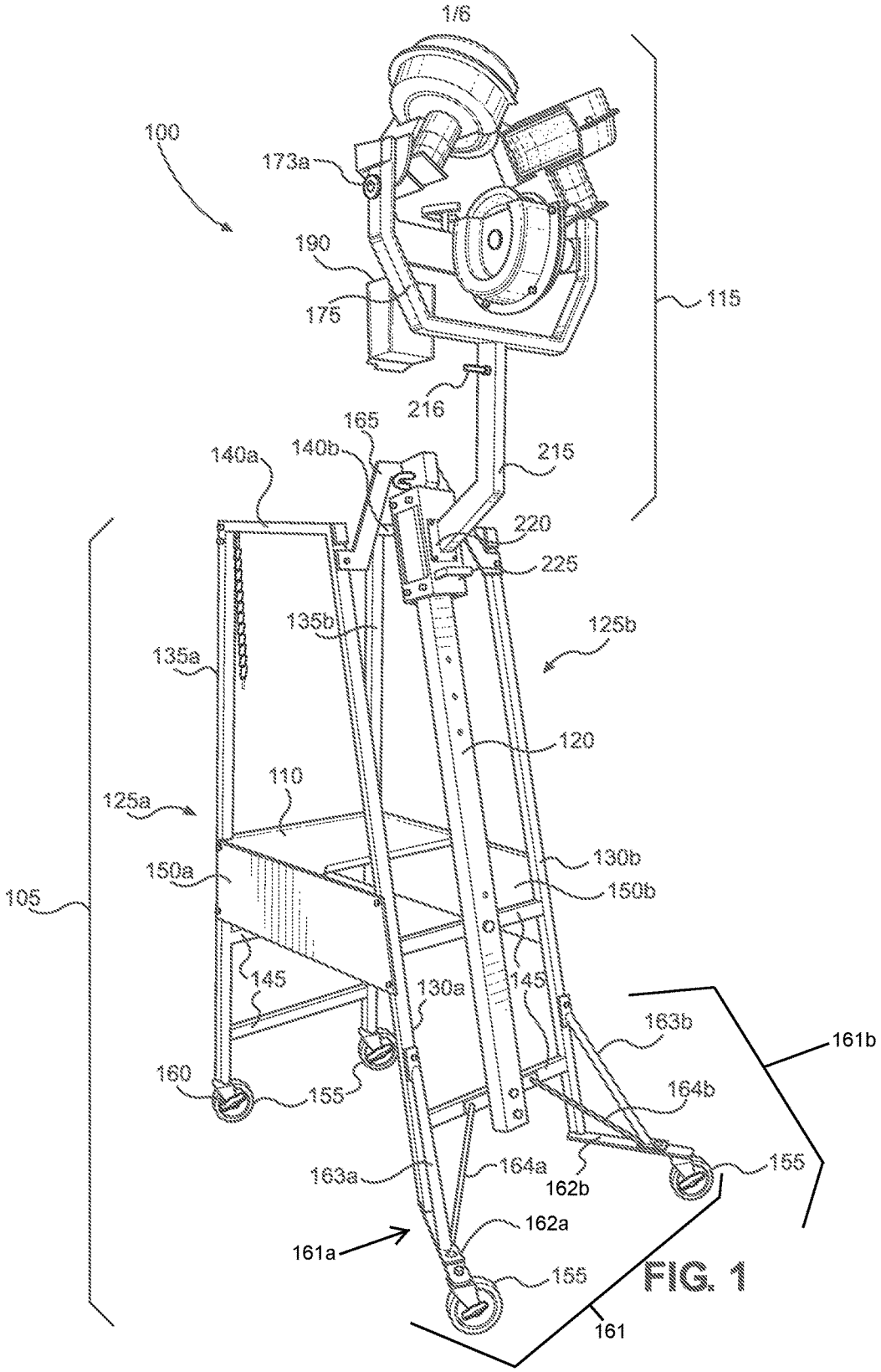
FIG. 1 is a perspective view of a device to pitch volleyballs.

FIG. 1 is a front perspective view of a volleyball pitching machine 100. Pitching machine 100 has a base frame 105 with an integrated operator stand 110, a throwing head 115 and a throwing head position adjustment rack 120. Base frame 105 has two sides 125*a*, 125*b*, each with a vertically oriented front member 130*a*, 130*b* and a vertically oriented rear member 135*a*, 135*b*. Horizontally oriented top members 140*a*, 140*b* are positioned at the top of frame 105 on each side 125*a*, 125*b* respectively, and act as a railing for operator stand 110 to keep an operator from falling off of operator stand 110 to either side. Top member 140 is affixed between the top of front member 130 and rear member 135. A set of cross members 145 secure sides 125*a*, 125*b* to each other to form and stabilize base frame 105. Side panels 150 also form and stabilize base frame 105 and provide a surface for placement of product information to be displayed. Operator stand 110 is a horizontal platform on which an operator can stand during operation of pitching machine 100 and is affixed between sides 125 of base frame 105.

Base frame 105 further includes front member outriggers 161. Outriggers 161*a*, 161*b* each include: a frame extender 162*a*, 162*b*; a front member brace 163*a*, 163*b* and a cross member brace 164*a*, 164*b*. Outriggers 161*a*, 161*b* are angled outwardly from the center of base frame 105 to provide stability to apparatus 100. It should be understood that throwing head 115 may be positioned at a height as high as about 10 feet above the ground to approximate the height of a jump serve release point. Throwing head 115 is heavy, weighing approximately 75 pounds. Therefore, it is necessary to balance the weight across a large frame and outriggers 161*a*, 161*b* help to do so. Base frame 105 is approximately 4 feet measured between each rear wheel and front wheel pair, approximately 2 feet between the two rear wheels, and approximately 3 feet, 3 inches between the two front wheels. The dimensions as described allow apparatus 100 to have a high degree of stability while throwing head 115 is locked in any position along rack bar 120. At the same time, apparatus 100 is still highly portable and is configured to move easily through any standard gymnasium door provided throwing head 115 is lowered on rack bar 120. It should be understood that all of the dimensions described are approximate and could be altered depending on a particular design and to accommodate particular considerations of a user.

A set of wheels 155 for portability of machine 100 are affixed to the bottom of each front member 130*a*, 130*b* and each rear member 135*a*, 135*b*. An engageable lock 160 on each wheel allows the operator of the apparatus 100 to park apparatus 100 in a particular position on the court and have it remain stationary while pitching balls. It should be understood that apparatus 100 should only be moved while throwing head 115 is lowered on rack bar 120 to minimize the chance that it will tip over.

Affixed to the front side of base frame 105 is throwing head position adjustment rack 120. Adjustment rack 120 is formed of a vertically oriented bar 120 affixed to cross members 145 at the lower portion of base frame 105 and is angled in a rearward direction to "lean" back towards the center of gravity of base frame 105. This angled configuration helps with stability, particularly where throwing head 115 is positioned towards the top of rack 120. Adjustment rack 120 is fitted with holes or teeth either along the front or the sides along the length of adjustment rack bar 120. The top portion of adjustment rack 120 is affixed to base frame 105 with a stabilizer member 165 that also forms a cross member between sides 125*a*, 125*b* of base frame 105. Stabilizer member 165 is affixed to the top of adjustment rack bar 120.

Figure 2:
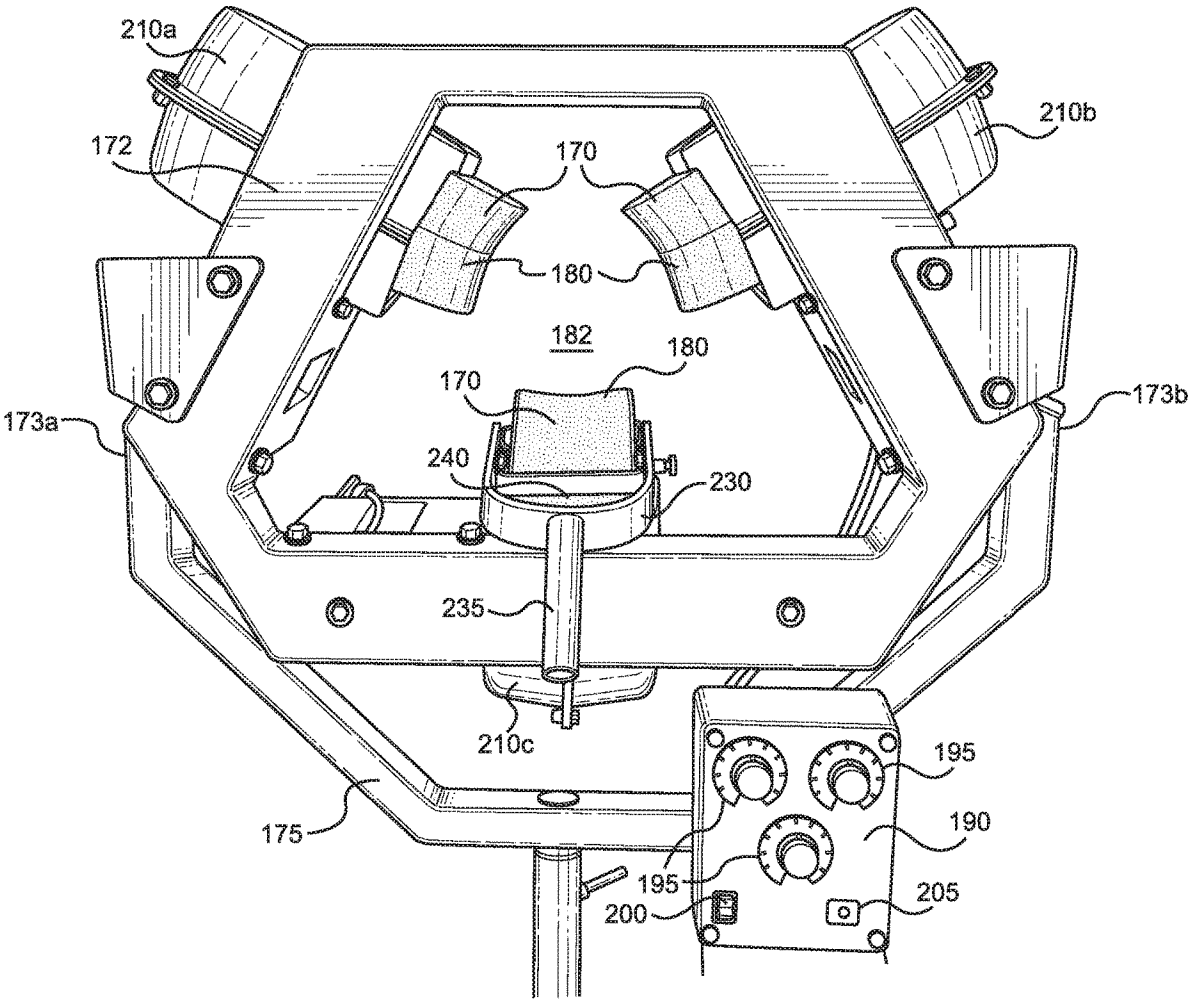
FIG. 2 is a perspective rear view of a throwing head of the device of FIG. 1.
Figure 3:
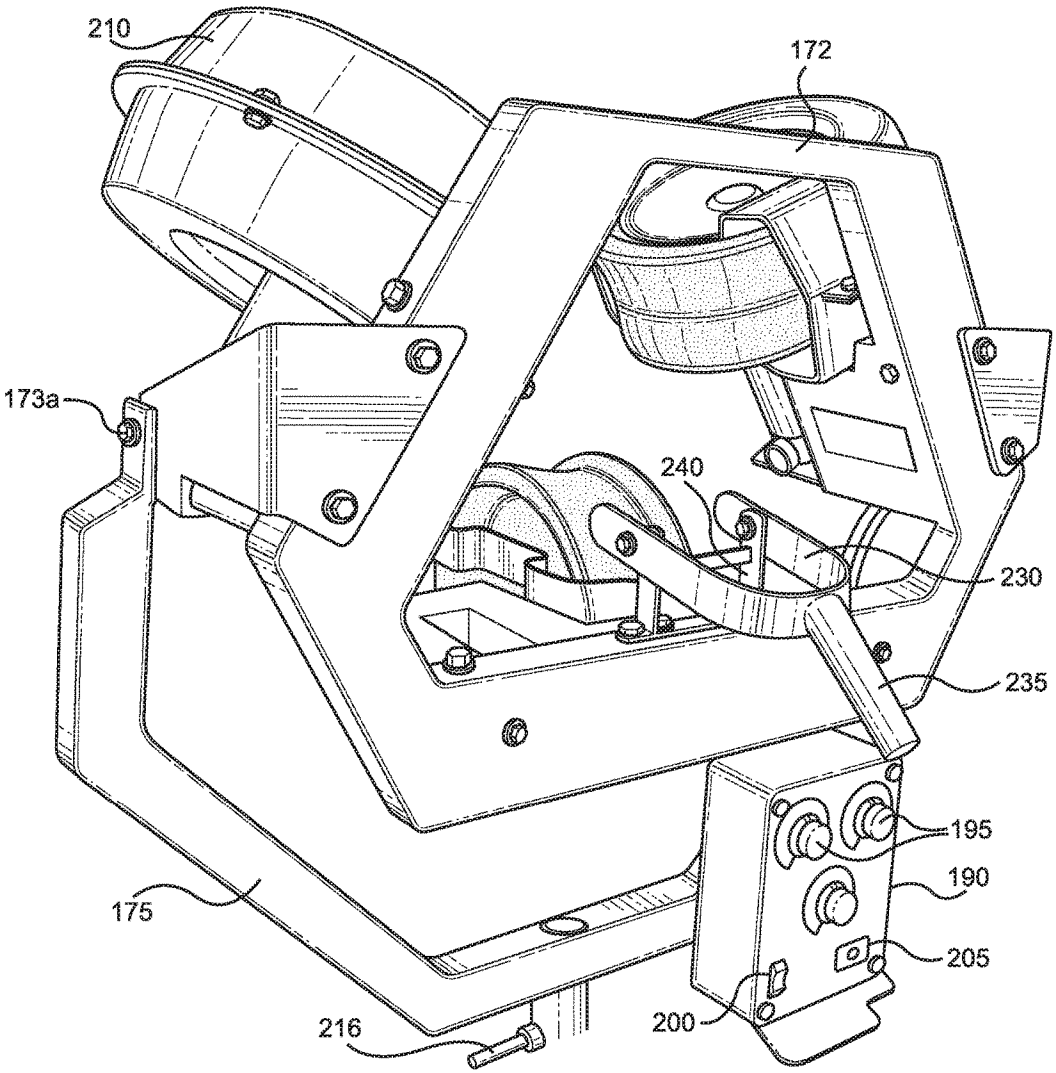
FIG. 3 is a perspective rear angled view of the throwing head of the device of FIG. 1.
Figure 4:
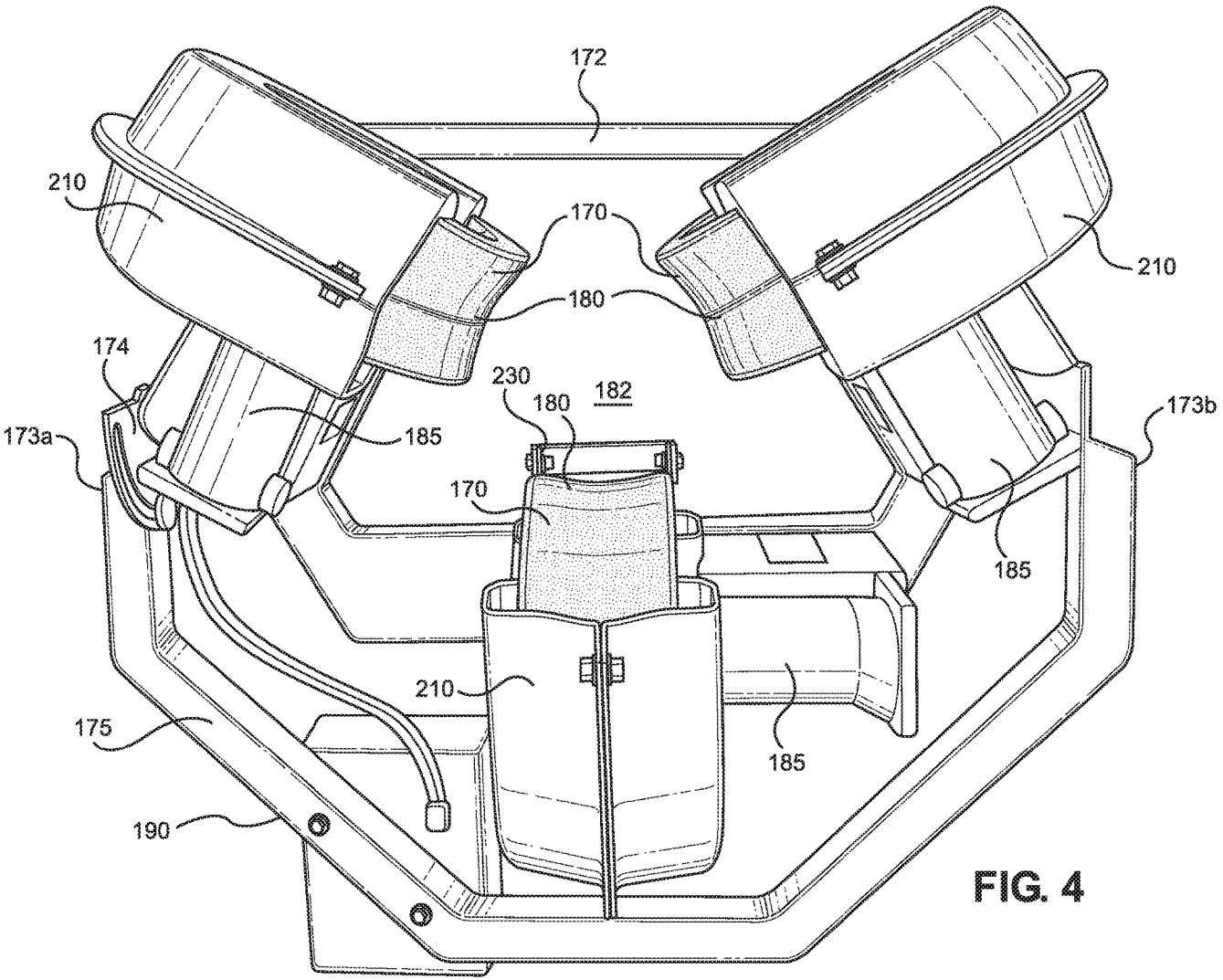
FIG. 4 is a perspective front view of the throwing head of the device of FIG. 1.
Figure 5:
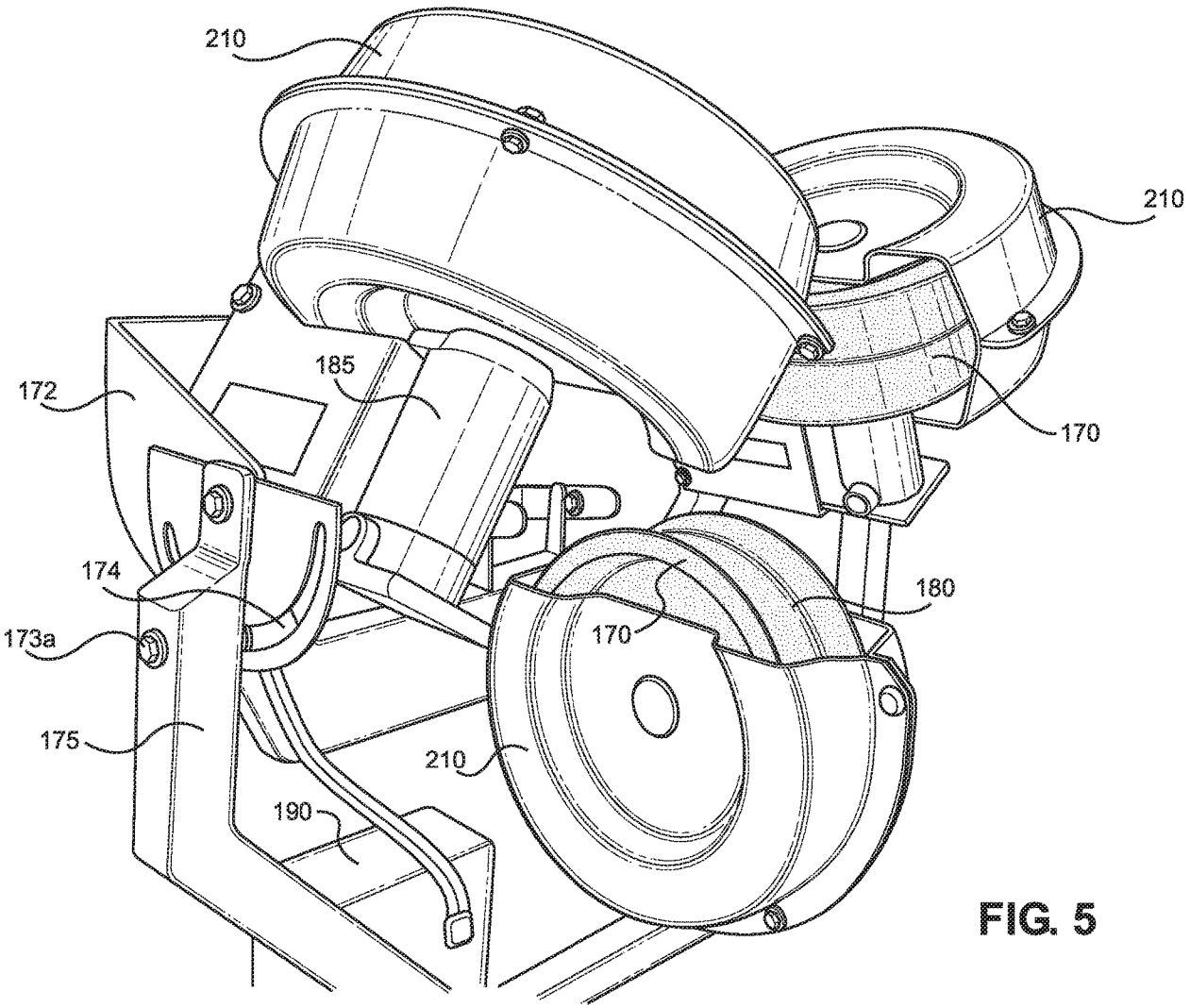
FIG. 5 is a perspective front angled view of a throwing head of the device of FIG. 1.

FIGS. 2-5 show detailed views of throwing head 115 with FIG. 2 showing a perspective rear view of throwing head 115, FIG. 3 showing a perspective rear angled view of throwing head 115, FIG. 4 showing a perspective front view of throwing head 15, and FIG. 5 showing a perspective front angled view of throwing head 115. Throwing head 115 includes a set of three ball throwing wheels 170*a*, 170*b*, 170*c* that are mounted on a subframe component 172 that fits within opposing sides of the top portion of head frame 175. Each of ball throwing wheels 170*a*, 170*b*, 170*c* preferably includes a concave peripheral edge 180 (see FIG. 2, 4) to maximize grip on a ball passing into an aperture 182 that is formed within the area between the peripheral edges of wheels 170. Ball throwing wheels 170*a*, 170*b*, 170*c* are affixed to subframe 172, that is in turn mounted to head frame 175, such that wheels 170 launch a ball from throwing head 115. Each wheel 170*a*, 170*b*, 170*c* is driven by a variable speed motor 185 (See FIG. 4) that is controlled by the operator using a control box 190 mounted to head frame 175. Control box 190 includes a variable speed switch adjusted by a knob 195 for each of motors 185. An on/off switch 200 as well as an indicator light 205 that shows apparatus 100 is turned "on" may also be included in control box 190. Each wheel 170 further includes a wheel guard 210 that is mounted to subframe 172 and covers a significant outer portion of wheel 170 so that an operator does not accidentally touch spinning wheels 170 during the loading process or while machine 100 is on and the wheels are spinning.

Head frame 175 includes a lower frame stand 215 that connects the upper portion of head frame 175 to rack bar 120. The base of lower frame stand 215 ends in a receiving frame 220 within which rack bar 120 fits. Receiving frame 220 slides vertically up and down along rack bar 120. The vertical adjustment allows an operator to set throwing head 115 at the top of the range of rack bar 120 so that players can practice hitting balls being launched in a sharp downward direction such as would approximate a spike or a serve. Throwing head 115 can be positioned at the bottom of rack bar 120 to practice hits launched in an upward trajectory such as for a set or serve. And, throwing head 115 can be anywhere along the length of rack bar 120 to approximate all other types of hits that players may need to practice, including for different age and skill level. An engagement handle 225, which may be spring loaded, can be depressed by the operator for adjustment purposes. Upon adjusting throwing head 115 to a desired height while handle 225 is depressed, handle 225 is released and it engages the teeth or holes along bar 120.

Aiming the ball is accomplished by adjusting head frame 175 at two different places. Subframe 172 can be rotated around the x-axis (See FIG. 6) to aim a ball in an upward or downward direction at rotation points 173*a*, 173*b*. A lockable pin or screw that moves within slot 174 can be tightened to maintain subframe 172 in any desired position. Additionally, head frame 175 may pivot around the z-axis (See FIG. 6) to aim a ball towards different positions across a court by turning head frame 175 about lower frame stand 215. Head frame 175 may be locked on frame stand 215 using a lock pin 216 on frame stand 215.

Providing three powered wheels 170*a*, 170*b*, 170*c*, the speed of which can be independently controlled using knobs 195 means that balls may be presented to the player with any possible spin for delivering different types of shots. The method of the invention allows the balls to be presented at any angle and with any spin anywhere on a court by adjusting the height of throwing head 115 on adjustment rack 120, in combination with the adjustments of head frame 175 about the x-axis and z-axis as described. In this way, all types of hits with different spins applied can be replicated for practice including, but not limited to setting, blocking, bumping, shooting, dinking, passing, tipping, digging, serving, killing and spiking from anywhere on the court.

Due to the weight and size of throwing head 115 perched atop frame 105, counterbalancing of throwing head 115 is suggested to maintain throwing head 115 in a stable position above frame 105 and to safely make adjustments of throwing head 115 up and down on rack bar 120 without throwing head 115 free-falling to the bottom of rack bar 120. A counterbalance may be in the form of a bungee cord (not shown) affixed at one end to receiving frame 220. The bungee cord may be routed around a pulley system to ensure proper tension at all times with the second end being affixed to the bottom of rack bar 120 or one of the cross members on frame 105.

An operator of machine 100 and players practicing using machine 100 must always avoid putting hands into aperture 182 or near spinning wheels 170 while machine 100 is turned on. To facilitate use of machine 100, a ball loader 230 includes a collapsible handle 235 with a ball seat 240. Ball loader 230 is pivotally mounted to the top of lower wheel guard 210*c*. An operator loads a ball onto loader seat 240 while loader is in the lowered position, and then swings loader 230 up using handle 235. As the ball is rotated up and into aperture 182, it is "grabbed" by spinning wheels 170 and launched from throwing head 115 while the operator's hands remain at a safe distance from wheels 170.

Handle 235 on ball loader 230 may be collapsed by pivoting handle 235 back onto loader seat 240. By doing so, the profile of machine 100 may be lowered when subframe 172 is rotated on rotation points 173*a*, 173*b* such that wheels 170 are on the bottom and oriented vertically, and handle 235 of ball loader 240 is on top in frame stand 175. When placed in the collapsed position, handle 235 does not stick up from subframe 172 thereby lowering the profile of throwing head 115 and allowing machine 100 to be easily transported through a standard gymnasium door without the need to disengage throwing head 115 from frame 105.

The operation of machine 100 will now be described. First, the operator turns on machine 100 using switch 200 on control box 190. Each wheel 170*a*, 170*b*, 170*c* is adjusted to the desired speed using corresponding knobs 195. If all three motors 185 are set to the same speed, the ball being pitched will have no spin. If the three motors are spinning at different speeds, spin will be imparted to the ball as it is launched in a particular direction depending on the relative speeds of the motors. The arc of the spin will be greater as the difference in the speeds of the motors is increased. With three motors, being fully adjustable, any spin in any direction can be imparted to a ball.

Figure 6:
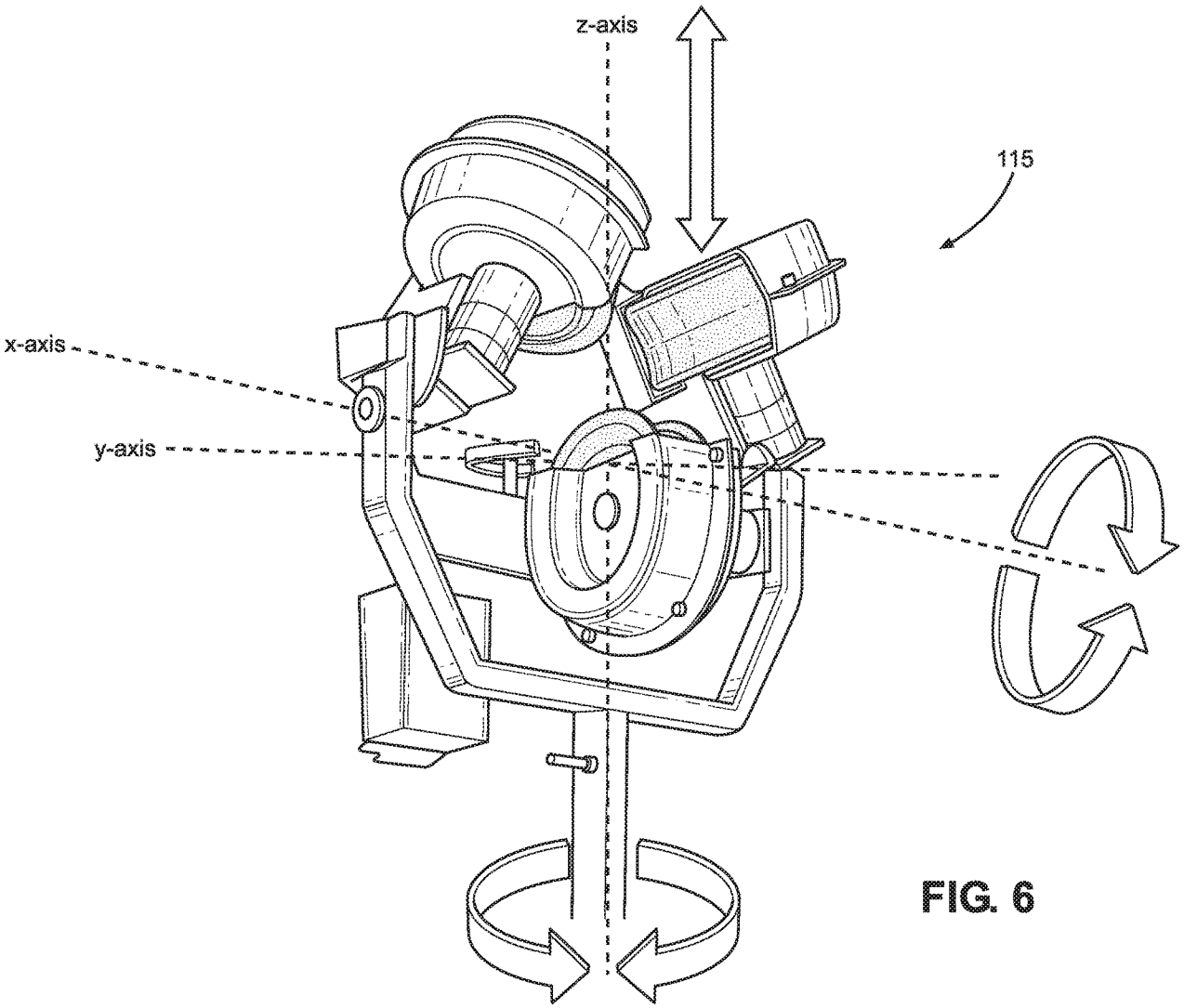
FIG. 6 is a perspective view of a throwing head of the device of FIG. 1 showing adjustability in three dimensional space

The operator adjusts the height of head frame 172 along the z-axis as shown in FIG. 6 by sliding receiving frame 220 up or down on rack bar 120 using engagement handle 225. The direction of the trajectory of the ball is adjusting by pivoting head frame 175 around the z-axis on stand 215 and locking it in place using pin 216. The operator then climbs onto operator stand 110 and rotates subframe 172 around the x-axis as shown in FIG. 6 on pins 173 before locking subframe 172 in place by tightening pin 173 in slot 174. The operator is then ready to launch a ball. He places the ball in seat 240 of loader 230. Loader is pivoted up using handle 235 and the ball is introduced to wheels 170*a*, 170*b*, 170*c*. It passes through aperture 182 and is launched.

While the invention has been described with respect to the FIGS. 1-5, it will be appreciated that many modifications and changes may be made by those skilled in the art without departing from the spirit of the invention. Any variation and derivation from the above description and drawings are included in the scope of the present invention as defined by the claims.

The invention claimed is:

1. An apparatus for pitching balls to a player, comprising:
- a base frame comprising:
  - a first side;
  - a second side;
  - a set of cross members affixed between the first side and the second side;
  - an outrigger affixed to a first point on a front portion of each of the first side and the second side, each outrigger comprising (i) a frame extender extending outwardly from the first point of the respective side and (ii) a brace coupling a distal end of each frame extender to a second point on each respective side; and
  - an operator stand positioned between the first side and the second side configured to support an operator at a height above a bottom of the base frame;
- a rack bar affixed to a front portion of the frame;
- a throwing head comprising:
  - a frame stand with a first end mounted to the rack bar and configured to slide up and down along a length of the rack bar in a plurality of positions;
  - a head frame with a first end pivotally mounted on a second end of the frame stand;
  - a subframe rotationally mounted on a second end of the head frame and configured with three powered throwing wheels wherein a peripheral edge of each throwing wheel forms a boundary of an aperture; and
  - a ball loader mounted on the subframe configured to introduce a ball into the aperture; and
- a control box with at least one variable switch that controls a speed of each of the powered wheels.

2. The apparatus of claim 1 wherein the peripheral edge of each of the powered throwing wheels is concave.

3. The apparatus of claim 1 further comprising a wheel guard positioned over at least a portion of each powered throwing wheel.

4. The apparatus of claim 1 wherein the outriggers are angled away relative to each other at the front of the frame.

5. The apparatus of claim 1 wherein a height of the throwing head when the frame stand is raised to a highest position on the rack bar is approximately the height of a jump serve release point.

6. The apparatus of claim 1 wherein a height of the throwing head when the frame stand is lowered to a lowest position on the rack bar approximates the height of a set pass release point.

7. The apparatus of claim 1 wherein a speed of each of the three powered wheels is adjustable by an operator using the at least one variable switch such that a change in a relative speed between the three powered wheels alters an axis of spin of the ball upon being launched to provide a trajectory with a desired curve.

8. The apparatus of claim 1 wherein the ball chute loader further comprises a collapsible handle configured to pivot into position on ball loader.

9. The apparatus of claim 1 wherein a top of the rack bar is angled rearward relative to a bottom of the rack bar towards a center area of the base frame.

10. The apparatus of claim 1 further comprising a first set of wheels affixed to a bottom rear portion of the base frame and a second set of wheels affixed to the outriggers.

11. An method for pitching balls to a player, comprising:
- providing a base frame comprising:

a first side;

a second side;

a set of cross members affixed between the first side and the second side;

an outrigger affixed to a first point on a front portion of each of the first side and the second side, each outrigger comprising (i) a frame extender extending outwardly from the first point of the respective side and (ii) a brace coupling a distal end of each frame extender to a second point on each respective side; and an operator stand positioned between the first side and the second side configured to support an operator at a height above a bottom of the base frame;

affixing a rack bar to a front portion of the frame;

mounting a throwing head on the base frame, wherein the throwing head comprises:

a frame stand with a first end mounted to the rack bar and configured to slide up and down along a length of the rack bar in a plurality of positions;

a head frame with a first end pivotally mounted on a second end of the frame stand;

three powered wheels each having a peripheral edge, wherein the three powered wheels are mounted within the head frame;

a subframe rotationally mounted on a second end of the head frame; and a ball loader mounted on the subframe configured to introduce a ball into an aperture;

controlling a speed of each of the powered wheels using at least one switch; and configuring the three powered throwing wheels in the head frame such that a boundary of the aperture is formed by the peripheral edge of each of the powered wheels.

12. The method of claim 11 wherein the peripheral edge of each of the powered throwing wheels is concave.

13. The method of claim 11 wherein the throwing head further comprises a wheel guard positioned over at least a portion of each powered throwing wheel.

14. The method of claim 11 wherein the outriggers are angled away relative to each other at the front of the frame.

15. The method of claim 11 further comprising raising the frame stand to a highest position on the rack bar wherein the frame stand is approximately the height of a jump serve release point.

16. The method of claim 11 further comprising lowering the frame stand to a lowest position on the rack bar wherein the frame stand is approximately the height of a set pass release point.

17. The method of claim 11 wherein a speed of each of the three powered wheels is adjustable by an operator using the at least one variable switch such that a change in a relative speed between the three powered wheels alters an axis of spin of the ball upon being launched to provide a trajectory with a desired curve.

18. The method of claim 11 wherein the ball chute loader further comprises a collapsible handle configured to pivot into position on ball loader.

19. The method of claim 11 wherein a top of the rack bar is angled rearward relative to a bottom of the rack bar towards a center area of the base frame.

20. The method of claim 11 wherein a first set of wheels is affixed to a bottom rear portion of the base frame and a second set of wheels is affixed to the outriggers.

21. A volleyball pitching machine, comprising:

a base frame comprising:

a first side;

a second side;

a set of cross members affixed between the first side and the second side; and a cantilever balancing element extending horizontally outwardly from the base frame in a first direction;

a rack bar affixed to a front portion of the base frame;

a throwing head comprising:

a cantilevered frame stand with a first end mounted to the rack bar and configured to slide up and down along a length of the rack bar in a plurality of positions, and a second end extending outwardly from the base frame in the first direction;

a head frame with a first end pivotally mounted on the second end of the cantilevered frame stand;

a subframe rotationally mounted on a second end of the head frame and configured with three powered throwing wheels wherein a peripheral edge of each throwing wheel forms a boundary of an aperture; and a ball loader mounted on the subframe configured to introduce a ball into the aperture; and a control box with at least one variable switch that controls a speed of each of the powered wheels.

* * * * *